US008851832B2

(12) United States Patent
Andrus

(10) Patent No.: US 8,851,832 B2
(45) Date of Patent: Oct. 7, 2014

(54) ENGINE AND VANE ACTUATION SYSTEM FOR TURBINE ENGINE

(75) Inventor: Dawn Kay Andrus, Avon, IN (US)

(73) Assignee: Rolls-Royce North American Technologies, Inc., Indianapolis, IN (US)

( * ) Notice: Subject to any disclaimer, the term of this patent is extended or adjusted under 35 U.S.C. 154(b) by 323 days.

(21) Appl. No.: 12/958,160

(22) Filed: Dec. 1, 2010

(65) Prior Publication Data

US 2011/0158792 A1 Jun. 30, 2011

Related U.S. Application Data

(60) Provisional application No. 61/291,529, filed on Dec. 31, 2009.

(51) Int. Cl.
*F01D 17/12* (2006.01)
*F01D 17/16* (2006.01)
*F04D 29/56* (2006.01)

(52) U.S. Cl.
CPC ..... *F01D 17/162* (2013.01); *F04D 29/563* (2013.01)
USPC ..... 415/160

(58) Field of Classification Search
USPC ..... 415/148, 149.1, 149.2, 149.4, 151, 155, 415/159, 160, 162
See application file for complete search history.

(56) References Cited

U.S. PATENT DOCUMENTS

| | | | | |
|---|---|---|---|---|
| 3,816,021 | A | | 6/1974 | Lewis et al. |
| 3,990,809 | A | | 11/1976 | Young et al. |
| 4,264,270 | A | | 4/1981 | Geary, Jr. |
| 4,390,318 | A | | 6/1983 | Weiler |
| 4,652,208 | A | | 3/1987 | Tameco |
| 4,657,476 | A | | 4/1987 | Berg |
| 4,664,594 | A | | 5/1987 | Mandet et al. |
| 4,668,165 | A | | 5/1987 | Ludwick |
| 4,679,984 | A | | 7/1987 | Swihart et al. |
| 4,826,399 | A | | 5/1989 | Perez |
| 5,466,122 | A | * | 11/1995 | Charbonnel et al. ..... 415/160 |
| 5,549,448 | A | * | 8/1996 | Langston ..... 415/149.4 |
| 6,401,563 | B1 | | 6/2002 | Franklin |
| 6,582,190 | B2 | | 6/2003 | Jinnai |
| 6,659,718 | B2 | | 12/2003 | Jinnai et al. |
| 2002/0119042 | A1 | | 8/2002 | Yoshimura et al. |
| 2004/0115045 | A1 | | 6/2004 | Alexander et al. |
| 2004/0240989 | A1 | | 12/2004 | Willshee et al. |
| 2004/0240990 | A1 | | 12/2004 | Rockley |

* cited by examiner

*Primary Examiner* — Edward Look
*Assistant Examiner* — Maxime Adjagbe
(74) *Attorney, Agent, or Firm* — Krieg DeVault LLP

(57) ABSTRACT

One embodiment of the present invention is a unique turbine engine. Another embodiment is a unique vane actuation system. In one form, the actuation system includes a four bar linkage. Other embodiments include apparatuses, systems, devices, hardware, methods, and combinations for turbine engines and vane actuation systems. Further embodiments, forms, features, aspects, benefits, and advantages of the present application shall become apparent from the description and figures provided herewith.

21 Claims, 3 Drawing Sheets

ENGINE AND VANE ACTUATION SYSTEM FOR TURBINE ENGINE

CROSS REFERENCE TO RELATED APPLICATIONS

The present application claims the benefit of U.S. Provisional Patent Application 61/291,529, filed Dec. 31, 2009, and is incorporated herein by reference.

FIELD OF THE INVENTION

The present invention relates to turbine engines, and, in particular, a vane actuation system for a turbine engine.

BACKGROUND

Actuation systems for variable geometry turbomachinery components, such as compressors in gas turbine engines, remain an area of interest. Some existing systems have various shortcomings, drawbacks, and disadvantages relative to certain applications. Accordingly, there remains a need for further contributions in this area of technology.

SUMMARY

One embodiment of the present invention is a unique turbine engine. Another embodiment is a unique vane actuation system. In one form, the actuation system includes a four bar linkage. Other embodiments include apparatuses, systems, devices, hardware, methods, and combinations for turbine engines and vane actuation systems. Further embodiments, forms, features, aspects, benefits, and advantages of the present application shall become apparent from the description and figures provided herewith.

BRIEF DESCRIPTION OF THE DRAWINGS

The description herein makes reference to the accompanying drawings wherein like reference numerals refer to like parts throughout the several views, and wherein.

DETAILED DESCRIPTION

Figure 1:
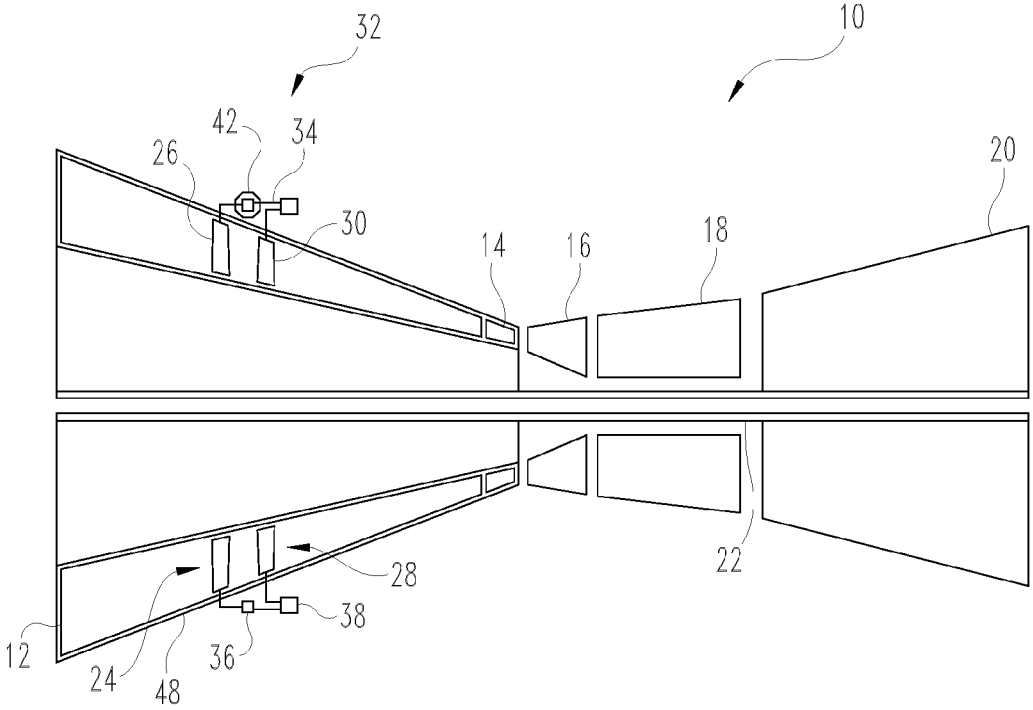
FIG. 1 schematically depicts a gas turbine engine having a four bar linkage vane actuation system in accordance with an embodiment of the present invention.

For purposes of promoting an understanding of the principles of the invention, reference will now be made to the embodiments illustrated in the drawings, and specific language will be used to describe the same. It will nonetheless be understood that no limitation of the scope of the invention is intended by the illustration and description of certain embodiments of the invention. In addition, any alterations and/or modifications of the illustrated and/or described embodiment(s) are contemplated as being within the scope of the present invention. Further, any other applications of the principles of the invention, as illustrated and/or described herein, as would normally occur to one skilled in the art to which the invention pertains, are contemplated as being within the scope of the present invention.

Referring now to the drawings, and in particular, FIG. 1, a non-limiting example of a gas turbine engine 10 in accordance with an embodiment of the present invention is schematically depicted. In one form, gas turbine engine 10 is a turbofan engine, e.g., an aircraft propulsion power plant. In other embodiments, gas turbine engine 10 may be any gas turbine engine configuration, such as a turbojet engine, a turboprop engine, and/or a turboshaft engine. In one form, engine 10 is an axial flow engine. In other embodiments, engine 10 may have axial, centrifugal and/or axi-centrifugal compressors and/or turbines. Embodiments of the present invention include both single-spool engines and multi-spool engines. In some embodiments, engine 10 may be a steam turbine engine.

In one form, gas turbine engine 10 includes a compressor 12 with outlet guide vane (OGV) 14, a diffuser 16, a combustor 18 and a turbine 20. Diffuser 16 and combustor 18 are fluidly disposed between OGV 14 of compressor 12 and turbine 20. Turbine 20 is drivingly coupled to compressor 12 via a shaft 22.

Compressor 12 includes a plurality of blades (not shown) and vanes for compressing air. Two stages of vanes are depicted in FIG. 1 as a vane stage 24 having a plurality of vanes 26, and a vane stage 28 having a plurality of vanes 30. During the operation of gas turbine engine 10, air is drawn into the inlet compressor 12, and after having been compressed, is discharged via OGV 14 into diffuser 16. Diffuser 16 reduces the velocity of the pressurized air from compressor 12, and directs the pressurized air to combustor 18. Fuel is mixed with the air and combusted in combustor 18, and the hot gases exiting combustor 18 are directed into turbine 20, which extracts some of the energy from the hot gases to generate mechanical shaft power to drive compressor 12 via shaft 22. The hot gases exiting turbine 20 are directed into a nozzle (not shown), which provides the thrust output by gas turbine engine 10.

In order to maximize the efficiency of gas turbine engine 10, it may be desirable to vary the aerodynamic geometry of turbomachinery components of gas turbine engine 10 with changes in mass flow through the engine and/or changes thrust (power) output. For example, a variable geometry compressor may allow compressor operation closer to the compressor surge line throughout a range of engine operating speeds. Accordingly, embodiments of the present invention include a variable geometry system 32. In one form, variable geometry system 32 is operative to selectively increase or decrease the angle of attack of compressor vanes 26 and 30, for example, to enhance compressor 12 performance. In other embodiments, the angles of attack of other vane stages may also be controlled in addition to or in place of compressor vanes 26 and 30. In still other embodiments, variable geometry system 32 may be operative to selectively increase or decrease the angle of attack of turbine vanes in turbine 20.

Figure 2:
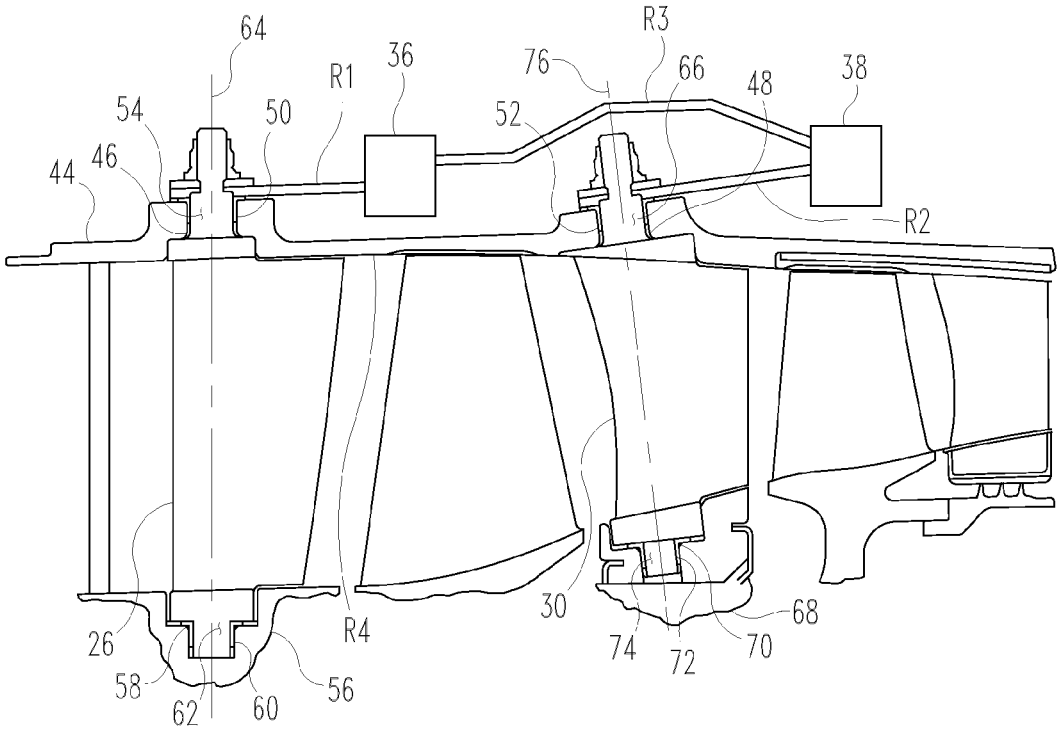
FIG. 2 is a cross section of a compressor having a four bar linkage vane actuation system in accordance with an embodiment of the present invention.

Referring now to FIG. 2 in conjunction with FIG. 1, variable geometry system 32 is described further. Variable geometry system 32 includes a vane actuation system 34 for changing the angle of attack of compressor vanes 26 and 30. Vane actuation system 34 includes a unison ring 36 for vane stage 24, a unison ring 38 for vane stage 28, a four bar linkage system 40, and an actuator 42.

Vane stage 24 and vane stage 28 are housed in a vane case, in particular, a compressor case 44, which in one form is a single case structure. Compressor case 44 may be formed of one ore more ring cases, e.g., one that houses both vane stage 24 and vane stage 28 or one ring case each for vane stage 24 and vane stage 28. Compressor case 44 may alternatively be a split case, e.g., split along a gas turbine engine 10 axial line.

Compressor case 44 includes a plurality of circumferentially spaced pilot openings 46 for piloting each vane 26 of vane stage 24. Compressor case 44 also includes a plurality of circumferentially spaced pilot openings 48 for piloting vanes 30 of vane stage 28. Disposed in each of openings 46 is a bushing 50. Disposed in each of pilot openings 48 is a bushing 52.

Each vane 26 includes a pivot shaft 54 that extends approximately radially outward from the tip of vane 26 into bushing 50. Disposed radially inward of each vane 26 is a vane support structure 56 having a plurality of circumferentially spaced pilot openings 58. Disposed in each pilot opening 58 is a bushing 60.

Each vane 26 includes a pivot shaft 62 that extends approximately radially inward into bushing 60. Pivot shaft 54 and pivot shaft 62, in conjunction with bushings 50, 60 and pilot openings 46, 58 define an axis of rotation 64. Each vane 26 is pivotable about axis of rotation 64 to increase or decrease the angle of attack of vane 26. Bushings 50 and 60 may reduce friction and wear of pivot shaft 54, pivot shaft 62, and pilot openings 46 and 58. Although the depicted embodiment includes bushings 50 and 60, other embodiments may not include bushings. Also, it will be noted that other schemes for piloting and positioning vanes 26 within compressor case 44 may be employed in other embodiments of the present invention.

Each vane 30 includes a pivot shaft 66 that extends approximately radially outward from the tip of vane 30 into bushing 52. Disposed radially inward of each vane 30 is a vane support structure 68 having a plurality of circumferentially spaced pilot openings 70. Disposed in each pilot opening 70 is a bushing 72. Each vane 30 includes a pivot shaft 74 that extends approximately radially inward into bushing 60.

Pivot shaft 66 and pivot shaft 74, in conjunction with bushings 52, 72 and pilot openings 48, 70 define an axis of rotation 76. Each vane 30 is pivotable about axis of rotation 76 to increase or decrease the angle of attack of vane 30. Bushings 52 and 72 may reduce friction and wear of pivot shaft 66, pivot shaft 74, and pilot openings 48 and 70. Although the depicted embodiment includes bushings 52 and 72, other embodiments may not include bushings. Also, it will be noted that other schemes for piloting and positioning vanes 30 within compressor case 44 may be employed in other embodiments of the present invention.

Four bar linkage system 40 includes a plurality of links, designated as links R1, R2, R3 and R4. A plurality of links R1 are pivotably coupled to unison ring 36, e.g., at one end. Each of the links R1 is also coupled to a vane 26 of vane stage 24, e.g., at the other end. Each link R1 is operable to rotate the vane 26 to which it is coupled. Links R1 may be, for example, sheet metal stampings. Rotational motion of unison ring 36 is transmitted through links R1 to each vane 26, whereby a rotation of unison ring 36 results in a rotation of each vane 26. Hence, a rotation of unison ring 36 in one direction increases the angle of attack of vanes 26, and a rotation of unison ring 36 in the opposite direction decreases the angle of attack of vanes 26.

A plurality of links R2 are pivotably coupled to unison ring 38, e.g., at one end. Each of the links R2 is also coupled to a vane 30 of vane stage 28, e.g., at the other end. Each link R2 is operable to rotate the vane 30 to which it is coupled. Links R2 may be, for example, sheet metal stampings. Rotational motion of unison ring 38 is transmitted through links R2 to each vane 30, whereby a rotation of unison ring 38 results in a rotation of each vane 30. Hence, a rotation of unison ring 38 in one direction increases the angle of attack of vanes 30, and a rotation of unison ring 38 in the opposite direction decreases the angle of attack of vanes 30.

A plurality of links R3 are pivotably coupled to unison ring 36, e.g., at one end. In one form, each link R3 is coupled to unison ring 36 at the same circumferential location as link R1 is coupled to unison ring 36, although different coupling locations may be employed in other embodiments. Each link R3 is also pivotably coupled to unison ring 38, e.g., at the other end. In one form, each link R3 is coupled to unison ring 38 at the same circumferential location as link R2 is coupled to unison ring 38, although different coupling locations may be employed in other embodiments. In one form, there is one link R3 for each vane 30 in vane stage 28. In other embodiments, greater or lesser numbers of links R3 may be utilized. The number of links R3 may vary with the loads anticipated during gas turbine engine 10 operations.

A plurality of links R4 are pivotably coupled to vanes 26 and pivotably coupled to vanes 30. In one form, links R4 are stationary. In the present embodiment, compressor case 44 functions as plurality of links R4 by being pivotably coupled with each vane 26 and each vane 30. In other embodiments, links R4 may take other forms.

Actuator 42 is configured to provide mechanical power to vane actuation system 34 to rotate vanes 26 and 30 in a controlled manner. In one form, actuator 42 is a hydraulic actuator. In other embodiments, actuator 42 may take other forms, and may be, for example, an electric actuator and/or a pneumatic actuator. In one form, actuator 42 is coupled directly to unison ring 36, and is operable to supply an actuator force to impart rotation to unison ring 36, e.g., a rotation in a circumferential direction 78. In other embodiments, actuator 42 may be coupled directly to unison ring 38, and may be operable to supply an actuator force to impart rotation to unison ring 38, e.g., in circumferential direction 78. In still other embodiments, actuator 42 may be coupled to indirectly to both unison ring 36 and unison ring 38, e.g., via one or more links R3. In yet other embodiments, actuator 42 may be coupled to one or both of unison rings 36 and 38 by any convenient means in addition to or in place of arrangements set forth herein.

Figure 3:
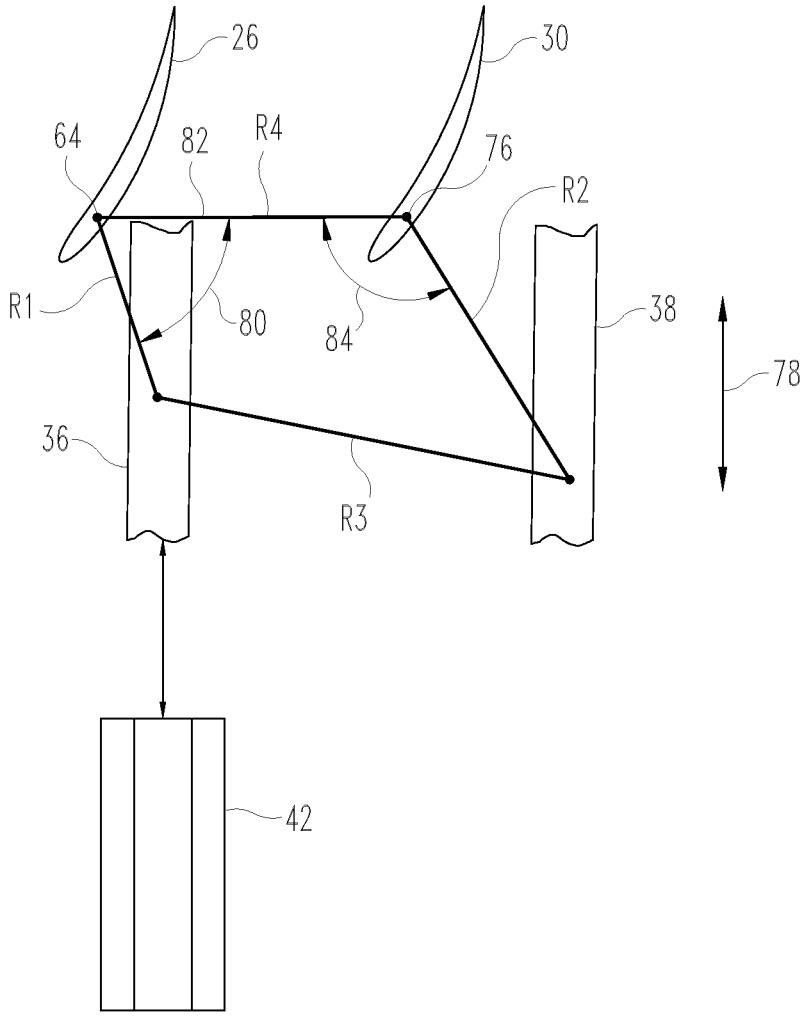
FIG. 3 is a schematic illustration of the four bar linkage system of FIG. 3.

Referring now to FIG. 3, the operation of vane actuation system 34 is described. The operation of vane actuation system 34 begins with actuator 42 supplying an actuator force to impart rotation of unison ring 36. Rotation of unison ring 36 in circumferential direction 78 imparts a rotation to each vane 26 via links R1, e.g., resulting in an angle 80 between link R1 and a line 82 extending between axis of rotation 64 and axis of rotation 76, which in one form may represent link R4. Rotation of unison ring 36 also imparts a rotation to unison ring 38 via link R3, e.g., also in circumferential direction 78, which imparts a rotation to each vane 30 via links R2, e.g., resulting in an angle 84 between link R2 and line 82. Compressor case 44 functions as links R4. Angles 80 and 84 may be readily determined using four-bar linkage calculations.

Embodiments of the present invention include a vane actuation system for a turbine engine. The vane actuation system may include a unison ring for a vane stage of the turbine engine; a plurality of first links, each first link being coupled to a vane of the vane stage, and each first link being pivotably coupled to the unison ring; an other unison ring for an other vane stage of the turbine engine; a plurality of second links, each second link being coupled to an other vane of the second vane stage, and each second link being pivotably coupled to the other unison ring; a third link pivotably coupled to each unison ring; and a fourth link pivotably coupled to the vane and the other vane.

In one refinement, the vane actuation system further comprises an actuator operable to supply an actuator force to at least one of the unison ring and the other unison ring. The actuator may be coupled to one of the unison ring and the other unison ring.

In another refinement, a rotation of the first link is operable to rotate the vane; and a rotation of the second link is operable to rotate the other vane.

In yet another refinement, the fourth link is stationary. The fourth link may be a vane case of the turbine engine. The vane case may a compressor vane case.

In still another refinement, the third link is pivotably coupled to the unison ring at a same circumferential location as one of the first links.

In yet still another refinement, the third link is pivotably coupled to the other unison ring at a same circumferential location as one of the second links.

In a further refinement, the vane actuation may further comprise a plurality of third links pivotably coupled to each of the unison ring and the other unison ring.

Another embodiment of the present invention may be a turbine engine. The turbine engine may comprise at least one of a fan section, a compressor section and a turbine section; a vane stage, the vane stage being at least one of a fan stage, a compressor stage and a turbine stage; an other vane stage, the other vane stage being at least one of an other fan stage, an other compressor stage and an other turbine stage; and a vane actuation system. The vane actuation may include: a unison ring for the vane stage; a plurality of first links, each first link being coupled to a vane of the vane stage, and each first link being pivotably coupled to the unison ring; an other unison ring for the other vane stage; a plurality of second links, each second link being coupled to an other vane of the other vane stage, and each second link being pivotably coupled to the other unison ring; a third link pivotably coupled to each unison ring; and a fourth link pivotably coupled to a vane of the vane stage and a vane of the other vane stage.

In one refinement, the turbine engine may further comprise an actuator operable to supply an actuator force to at least one of the unison ring and the other unison ring. The actuator may be coupled to one of the unison ring and the other unison ring.

In another refinement, a rotation of the first link is operable to rotate the vane; and a rotation of the second link is operable to rotate the other vane.

In yet another refinement, the fourth link is stationary. In an additional refinement, the turbine engine may include a vane case for the at least one of the fan section, the compressor section and the turbine section, wherein the vane case serves as the fourth link. The vane case may be a compressor vane case.

In still another refinement, the third link may be pivotably coupled to the unison ring at a same circumferential location as one of the first links.

In a further refinement, the third link is pivotably coupled to the other unison ring at a same circumferential location as one of the second links.

In yet still another refinement, the turbine engine may further comprise a plurality of third links pivotably coupled to each of the unison ring and the other unison ring.

Yet another embodiment may include a turbine engine. The turbine engine may comprise at least one of a fan section, a compressor section and a turbine section; a vane stage, the vane stage being at least one of a fan stage, a compressor stage and a turbine stage; an other vane stage, the other vane stage being at least one of an other fan stage, an other compressor stage and an other turbine stage; and a vane actuation system. The vane actuation system may include means for coupling the rotation of the vanes of the vane stage with the rotation of the vanes of the other vane stage.

While the invention has been described in connection with what is presently considered to be the most practical and preferred embodiment, it is to be understood that the invention is not to be limited to the disclosed embodiment(s), but on the contrary, is intended to cover various modifications and equivalent arrangements included within the spirit and scope of the appended claims, which scope is to be accorded the broadest interpretation so as to encompass all such modifications and equivalent structures as permitted under the law. Furthermore it should be understood that while the use of the word preferable, preferably, or preferred in the description above indicates that feature so described may be more desirable, it nonetheless may not be necessary and any embodiment lacking the same may be contemplated as within the scope of the invention, that scope being defined by the claims that follow. In reading the claims it is intended that when words such as "a," "an," "at least one" and "at least a portion" are used, there is no intention to limit the claim to only one item unless specifically stated to the contrary in the claim. Further, when the language "at least a portion" and/or "a portion" is used the item may include a portion and/or the entire item unless specifically stated to the contrary.

What is claimed is:

1. A vane actuation system for a turbine engine, comprising:

a unison ring for a vane stage of the turbine engine;

a plurality of first links, each first link being coupled to a vane of the vane stage, and each first link being pivotably coupled to said unison ring;

an other unison ring for an other vane stage of the turbine engine, wherein said unison ring and said other unison ring are not both disposed between said vane stage and said other vane stage;

a plurality of second links, each second link being coupled to an other vane of the second vane stage, and each second link being pivotably coupled to said other unison ring;

a third link having first and second ends, wherein the first and second ends of the third link are pivotably coupled to the unison ring and the other unison ring, respectively; and a fourth link pivotably coupled to said vane and said other vane, wherein the first, second, third and fourth links are configured to form a four-bar linkage; and wherein the four-bar linkage is configured to transmit rotation imparted to the unison ring from the unison ring to the other unison ring and/or to transmit rotation imparted to the other unison ring from the other unison ring to the unison ring.

2. The vane actuation system of claim 1, further comprising an actuator operable to supply an actuator force to at least one of said unison ring and said other unison ring.

3. The vane actuation system of claim 2, wherein said actuator is coupled to one of said unison ring and said other unison ring.

4. The vane actuation system of claim 1, wherein a rotation of said first link is operable to rotate the vane; and wherein a rotation of said second link is operable to rotate the other vane.

5. The vane actuation system of claim 1, wherein said fourth link is stationary.

6. The vane actuation system of claim 5, wherein said fourth link is a vane case of said turbine engine.

7. The vane actuation system of claim 6, wherein the vane case is a compressor vane case.

8. The vane actuation system of claim 1, wherein said third link is pivotably coupled to said unison ring at a same circumferential location as one of said first links.

9. The vane actuation system of claim 1, wherein said third link is pivotably coupled to said other unison ring at a same circumferential location as one of said second links.

10. The vane actuation system of claim 1, further comprising a plurality of third links pivotably coupled to each of said unison ring and said other unison ring.

11. A turbine engine, comprising:

at least one of a fan section, a compressor section and a turbine section;

a vane stage, said vane stage being at least one of a fan stage, a compressor stage and a turbine stage;

an other vane stage, said other vane stage being at least one of an other fan stage, an other compressor stage and an other turbine stage; and a vane actuation system, said vane actuation system including:

a unison ring for said vane stage;

a plurality of first links, each first link being coupled to a vane of said vane stage, and each first link being pivotably coupled to said unison ring;

an other unison ring for said other vane stage, wherein said unison ring and said other unison ring are not both disposed between said vane stage and said other vane stage;

a plurality of second links, each second link being coupled to an other vane of the other vane stage, and each second link being pivotably coupled to said other unison ring;

a third link having first and second ends, wherein the first and second ends of the third link are pivotably coupled to the unison ring and to the other unison ring, respectively; and a fourth link pivotably coupled to a vane of said vane stage and a vane of said other vane stage, wherein the first, second, third and fourth links are configured to form a four-bar linkage; and wherein the four-bar linkage is configured to transmit rotation imparted to the unison ring from the unison ring to the other unison ring and/or to transmit rotation imparted to the other unison ring from the other unison ring to the unison ring.

12. The turbine engine of claim 11, further comprising an actuator operable to supply an actuator force to at least one of said unison ring and said other unison ring.

13. The turbine engine of claim 12, wherein said actuator is coupled to one of said unison ring and said other unison ring.

14. The turbine engine of claim 11, wherein a rotation of said first link is operable to rotate the vane; and wherein a rotation of said second link is operable to rotate the other vane.

15. The turbine engine of claim 11, wherein said fourth link is stationary.

16. The turbine engine of claim 15, said turbine engine including a vane case for said at least one of said fan section, said compressor section and said turbine section, wherein said vane case serves as said fourth link.

17. The turbine engine of claim 16, wherein the vane case is a compressor vane case.

18. The turbine engine of claim 11, wherein said third link is pivotably coupled to said unison ring at a same circumferential location as one of said first links.

19. The turbine engine of claim 11, wherein said third link is pivotably coupled to said other unison ring at a same circumferential location as one of said second links.

20. The turbine engine of claim 11, further comprising a plurality of third links pivotably coupled to each of said unison ring and said other unison ring.

21. A turbine engine, comprising:

at least one of a fan section, a compressor section and a turbine section;

a vane stage, said vane stage being at least one of a fan stage, a compressor stage and a turbine stage;

a unison ring for said vane stage;

an other vane stage, said other vane stage being at least one of an other fan stage, an other compressor stage and an other turbine stage;

an other unison ring for said other vane stage, wherein said unison ring and said other unison ring are not both disposed between said vane stage and said other vane stage; and a vane actuation system, said vane actuation system including:

means for coupling the rotation of the vanes of said vane stage with the rotation of the vanes of said other vane stage, wherein said means for coupling includes a link having first and second ends pivotably connected to the unison ring and to the other unison ring, respectively.

* * * * *